US006033138A

United States Patent [19]

Kerr

[11] Patent Number: 6,033,138

[45] Date of Patent: Mar. 7, 2000

[54] MAGNETICALLY HELD MOTOR STOP FOR USE IN A PRINTER CARRIAGE FEED MECHANISM

[75] Inventor: Roger S. Kerr, Brockport, N.Y.

[73] Assignee: Eastman Kodak Company, Rochester, N.Y.

[21] Appl. No.: 09/080,841

[22] Filed: May 18, 1998

[51] Int. Cl.[7] ..... B41J 19/20

[52] U.S. Cl. ..... 400/328; 400/305; 74/89.15; 74/424.8 R

[58] Field of Search ..... 400/305, 328, 400/328.1; 74/89.15, 424.8 R

[56] References Cited

U.S. PATENT DOCUMENTS

| | | | |
|---|---|---|---|
| 4,535,344 | 8/1985 | Noda | 346/139 D |
| 4,567,737 | 2/1986 | Lonati | 66/55 |
| 5,268,708 | 12/1993 | Harshbarger et al. | 346/134 |
| 5,381,702 | 1/1995 | Ohno | 74/89.15 |
| 5,722,304 | 3/1998 | Allen | 74/586 |

*Primary Examiner*—John Hilten
*Assistant Examiner*—Daniel J. Colilla
*Attorney, Agent, or Firm*—Milton S. Sales

[57] ABSTRACT

An image processing apparatus (10) includes an imaging drum (300). A printhead (500) moves along a line parallel to the longitudinal axis (301) of the imaging drum as the imaging drum rotates. A linear drive motor (258) turns a lead screw (250) and is mounted directly onto the shaft of the lead screw. The motor is constrained from rotation by means of a rotational stop (296) that is magnetically held. A similar means is used to constrain a drum encoder (344).

17 Claims, 4 Drawing Sheets

MAGNETICALLY HELD MOTOR STOP FOR USE IN A PRINTER CARRIAGE FEED MECHANISM

FIELD OF THE INVENTION

This invention relates to an image processing apparatus that uses a printhead driven by lead screw rotation to write images, and specifically to a mechanical stop used for a motor that rotates the lead screw.

BACKGROUND OF THE INVENTION

U.S. Pat. No. 5,268,708 discloses an image processing apparatus arranged to form an intended image on a receiver secured to the periphery of an imaging drum while the drum is rotated past a printhead. A translation drive then traverses the printhead axially along the imaging drum, in coordinated motion with the rotating imaging drum. A scanning subsystem or write engine provides the scanning function by generating a once per revolution timing signal to data path electronics as a clock signal while the translation drive traverses the printhead axially along the imaging drum in a coordinated motion with the imaging drum rotating past the printhead.

The lathe bed scanning frame provides the structure to support the imaging drum and its rotational drive. The translation drive with the printhead are supported by two translation bearing rods that are substantially straight along their longitudinal axis and are positioned parallel to the imaging drum and a lead screw.

The above mentioned motion is accomplished by means of a DC. servo motor and encoder which rotates the lead screw that is, typically, aligned parallel with the axis of the imaging drum. The printhead is placed on the translation stage member supported by the front and rear translation bearing rods. The translation bearing rods are positioned parallel to the imaging drum, so that it automatically adopts the preferred orientation with respect to the surface of the imaging drum. The translation stage member and printhead are attached to a rotatable lead screw (having a threaded shaft) by a drive nut and coupling. The coupling is arranged to accommodate possible misalignment of the drive nut and lead screw so that only rotational forces and forces parallel to the lead screw are imparted to the translation stage member by the lead screw and drive nut. The lead screw rests between two sides of the lathe bed scanning frame of the lathe bed scanning subsystem or write engine, where it is supported by deep groove radial bearings. At the drive end the lead screw continues through the deep groove radial bearing, through a pair of spring retainers that are separated and loaded by a compression spring to provide axial loading, and to a DC. servo drive motor and encoder. The DC. servo drive motor induces rotation to the lead screw, moving the translation stage member and printhead along the threaded shaft as the lead screw is rotated. The lateral directional movement of the printhead is controlled by switching the direction of rotation of the DC. servo drive motor which, in turn, changes the direction of rotation of the lead screw.

Although the presently known and utilized image processing apparatus is satisfactory, it is not without drawbacks. The motor that drives the lead screw must operate in both directions and is required to start and stop quickly. The lead screw shaft itself is generally straight, but will have some out-of-round tolerances that the motor must be able to accommodate. As a result of these factors, this motor is subject to mechanical stress and its coupling to the lead screw shaft typically requires multiple parts that are assembled to work together to compensate for mechanical tolerance differences. The encoder coupling to the imaging drum also requires multiple components.

Known approaches that have been used to solve the above mentioned problems include complex coupling techniques, with multiple components used to couple the drive motor shaft to the lead screw shaft and spring-loading of the lead screw shaft to provide axial loading against these coupling components and against the drive motor shaft. This approach compensates for possible misalignment of the motor shaft and lead screw and allows sufficient "play" for minor mechanical tolerances. This approach requires alignment of the motor shaft and lead screw, both mounted on the frame. Using the above-mentioned approach, there is some torsional stress on the motor and on motor bearings as the motor starts and stops repeatedly during operation. This effectively reduces motor reliability and shortens motor life.

A similar coupling problem also presents itself for the mounting of the drum encoder. Mechanical tolerances of the shaft for the imaging drum can stress bearings in the encoder. To minimize the effect of tolerance differences, couplings using multiple components are employed for the drum encoder.

A solution that is well-known in the art for reducing torsional stress on a motor is direct attachment of the motor shaft to the lead screw shaft. With this approach, the lead screw then effectively supports the motor so that the motor is not mounted to a frame. Instead, a rotational stop, attached to the motor frame, prevents the motor from turning with the shaft. The same approach can be used for encoders.

Conventional motor stops used for this type of application are spring-held. Spring tension holds the rotational stop firmly against a fixed point, while allowing some amount of free-play of the motor frame as it turns the lead screw. However, springs present some drawbacks, including wear over time and susceptibility to vibration. Designers must carefully specify spring size, type, and strength. Spring retention requires additional hardware on the motor stop and on the equipment frame. Careful handling of springs is required during assembly and repair.

DISCLOSURE OF THE INVENTION

It is the object of the present invention to use a magnetically held rotational stop for the lead screw motor and encoder to overcome the drawbacks described above.

It is an advantage of the present invention that it reduces parts count for manufacture and assembly of the rotational stop.

It is an advantage of the present invention that it allows significant free movement of the motor during assembly and repair, allowing the motor, while mounted on the lead screw shaft, to be manually swung from its normal position without requiring removal or disassembly of components.

It is an advantage of the present invention that it allows significant free movement of the encoder during assembly and repair, allowing the encoder, while mounted on the imaging drum axis, to be manually swung from its normal position without requiring removal or disassembly of components.

It is an advantage of the present invention that it provides and maintains a single point of contact between the motor stop and the stationary surface to which the motor stop is held, using a rounded stop nut on the end of the motor stop.

It is an advantage of the present invention that it provides all of the mechanical holding capabilities of conventional spring-held rotational stops with the added benefit of single-point contact, allowing for a wider range of free-play than is available with conventional methods.

It is an advantage of the present invention that it utilizes no moving parts that could be damaged, removed, lost, or inadvertently disconnected.

It is an advantage of the present invention that it allows a variable amount of holding-power by specifying any of a variety of types of permanent magnets.

It is an advantage of the present invention that it can be used similarly with an encoder or other feedback sensing device mounted directly to a rotating shaft.

According to a feature of the present invention, a shaft is rotatably mounted on a frame. A motor coupled to and supported by the shaft, is adapted to drive the shaft. A rotational stop is attached to the motor, the rotational stop being magnetically held by the frame to prevent the motor rotating with the shaft.

According to a preferred embodiment of the present invention, the shaft is a threaded lead-screw rotatable mounted on the frame. A threaded carriage is mounted on the lead-screw for movement along the lead-screw as the lead-screw rotates. When used in a printer, the lead-screw may a printhead.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of imaging, it will be noted that the invention can be used with other applications. This invention could easily be implemented in any motor or encoder application where a rotational stop is employed.

Figure 1:
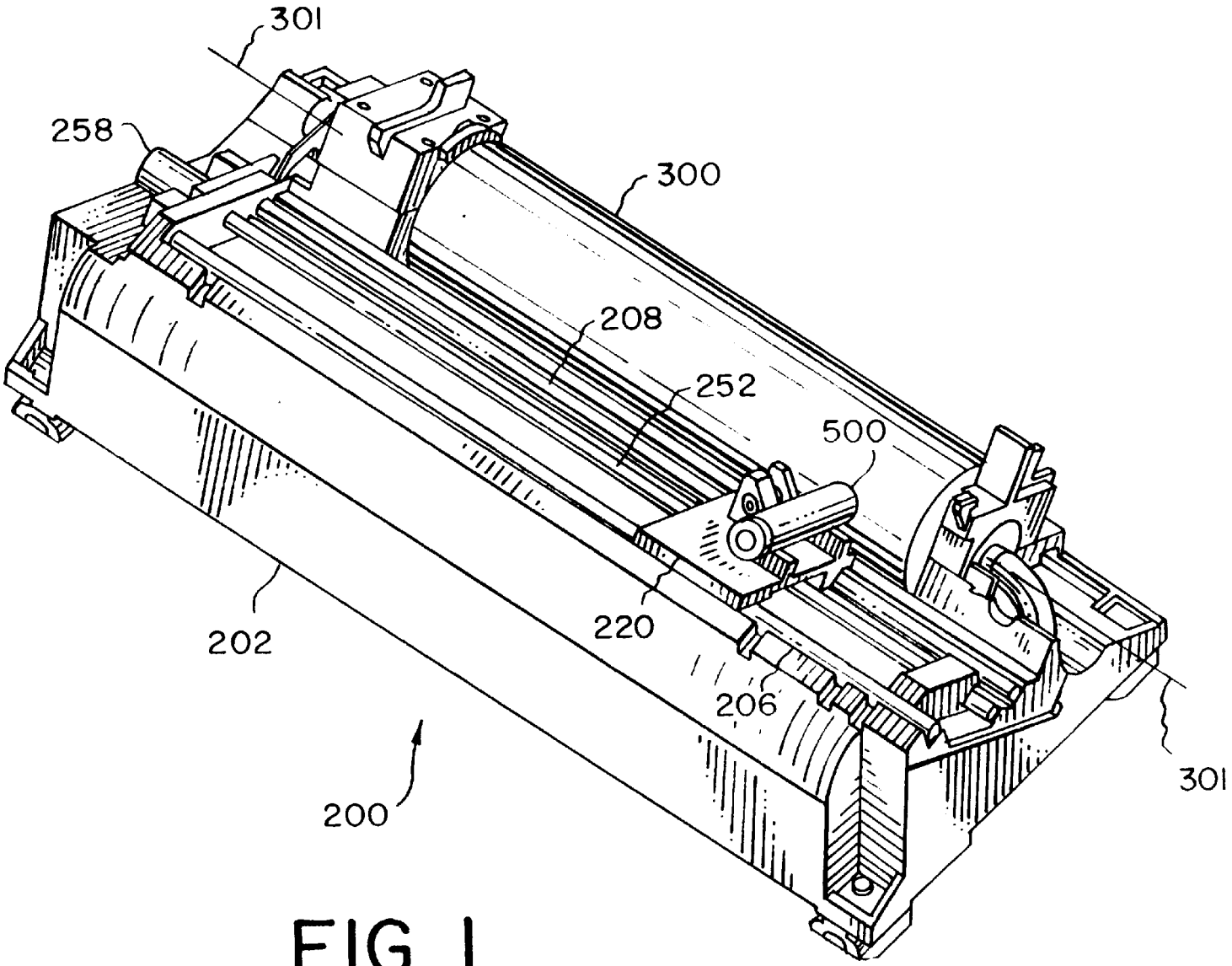
FIG. 1 is a perspective view of the lathe bed scanning subsystem or write engine of the present invention.

Referring to FIG. 1, there is illustrated a perspective view of the lathe bed scanning subsystem 200 of an image processing apparatus, including an imaging drum 300, a printhead 500 and lead screw 250 assembled in a lathe bed scanning frame 202. Imaging drum 300 is mounted for rotation about an axis 301 in lathe bed scanning frame 202. Printhead 500 is movable with respect to imaging drum 300, and is arranged to direct a beam of light to a receiver. The beam of light from printhead 500 is modulated by electronic signals from the image processing apparatus, which are representative of the shape and color of the original image.

Printhead 500 is mounted on a movable translation stage member 220 which, in turn, is supported for low friction slidable movement on a pair of rigid translation bearing rods 206 and 208, which are parallel to axis 301 of imaging drum 300. The axis of printhead 500 is perpendicular to axis 301 of imaging drum 300. Front translation bearing rod 208 locates translation stage member 220 in the vertical and the horizontal directions with respect to axis 301 of imaging drum 300. Rear translation bearing rod 206 locates translation stage member 220 only with respect to rotation of translation stage member 220 about front translation bearing rod 208, whereby there is no over-constraint condition of translation stage member 220 which might cause it to bind, chatter, or otherwise impart undesirable vibration or jitters to printhead 500 during the generation of an intended image.

Figure 2:
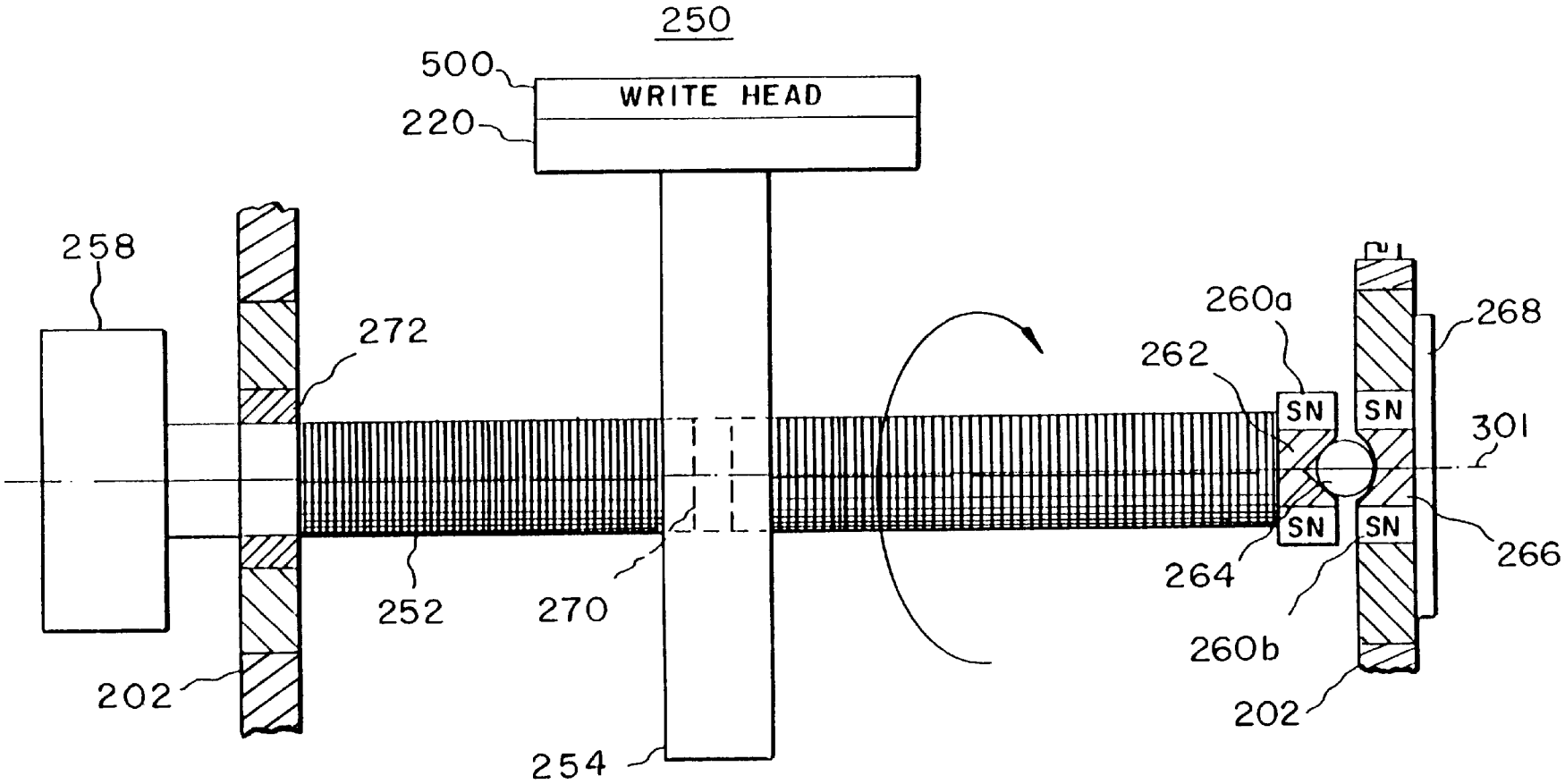
FIG. 2 is a top view in horizontal cross section, partially in phantom, of the lead screw of the present invention.

Referring to FIGS. 1 and 2, a lead screw 250 includes an elongated, threaded shaft 252 attached to a linear drive motor 258 on its drive end and to lathe bed scanning frame 202 by means of a radial bearing 272. A threaded carriage such as a lead screw drive nut 254 includes grooves in its hollowed-out center portion 270 for mating with the threads of threaded shaft 252 for permitting lead screw drive nut 254 to move axially along threaded shaft 252 as threaded shaft 252 is rotated by linear drive motor 258. Lead screw drive nut 254 is integrally attached to printhead 500 through a lead screw coupling (not shown) and translation stage member 220 at its periphery so that, as threaded shaft 252 is rotated by linear drive motor 258, lead screw drive nut 254 moves axially along threaded shaft 252, which in turn moves translation stage member 220 and ultimately printhead 500 axially along imaging drum 300.

As best illustrated in FIG. 2, an annular-shaped axial load magnet 260*a* is integrally attached to the driven end of threaded shaft 252, and is in a spaced apart relationship with another annular-shaped axial load magnet 260*b* attached to lathe bed scanning frame 202. Axial load magnets 260*a* and 260*b* are preferably made of rare-earth materials such as neodymium-iron-boron. A generally circular-shaped boss 262 part of threaded shaft 252 rests in the hollowed-out portion of annular-shaped axial load magnet 260*a*, and includes a generally V-shaped surface at the end for receiving a ball bearing 264. A circular-shaped insert 266 is placed in the hollowed-out portion of axial load magnet 260*b*, and includes an accurate-shaped surface on one end for receiving ball bearing 264, and a flat surface at its other end for receiving an end cap 268 placed over axial load magnet 260*b* and attached to lathe bed scanning frame 202 for protectively covering axial load magnet 260*b* and providing an axial stop for lead screw 250. Circular shaped insert 266 is preferably made of material such as Rulon J or Delrin AF, both well known in the art.

Lead screw 250 operates as follows. Linear drive motor 258 is energized and imparts rotation to lead screw 250, as indicated by the arrows, causing lead screw drive nut 254 to move axially along threaded shaft 252. Axial load magnets 260*a* and 260*b* are magnetically attracted to each other which prevents axial movement of lead screw 250. Ball bearing 264, however, permits rotation of lead screw 250 while maintaining the positional relationship of annular-shaped axial load magnets 260, i.e., slightly spaced apart, which prevents mechanical friction between them while permitting threaded shaft 252 to rotate.

Printhead 500 travels in a path along imaging drum 300, while being moved at a speed synchronous with imaging drum 300 rotation and proportional to the width of a writing swath, not shown. The pattern that printhead 500 transfers to a receiver on imaging drum 300, is a helix.

Figure 3:
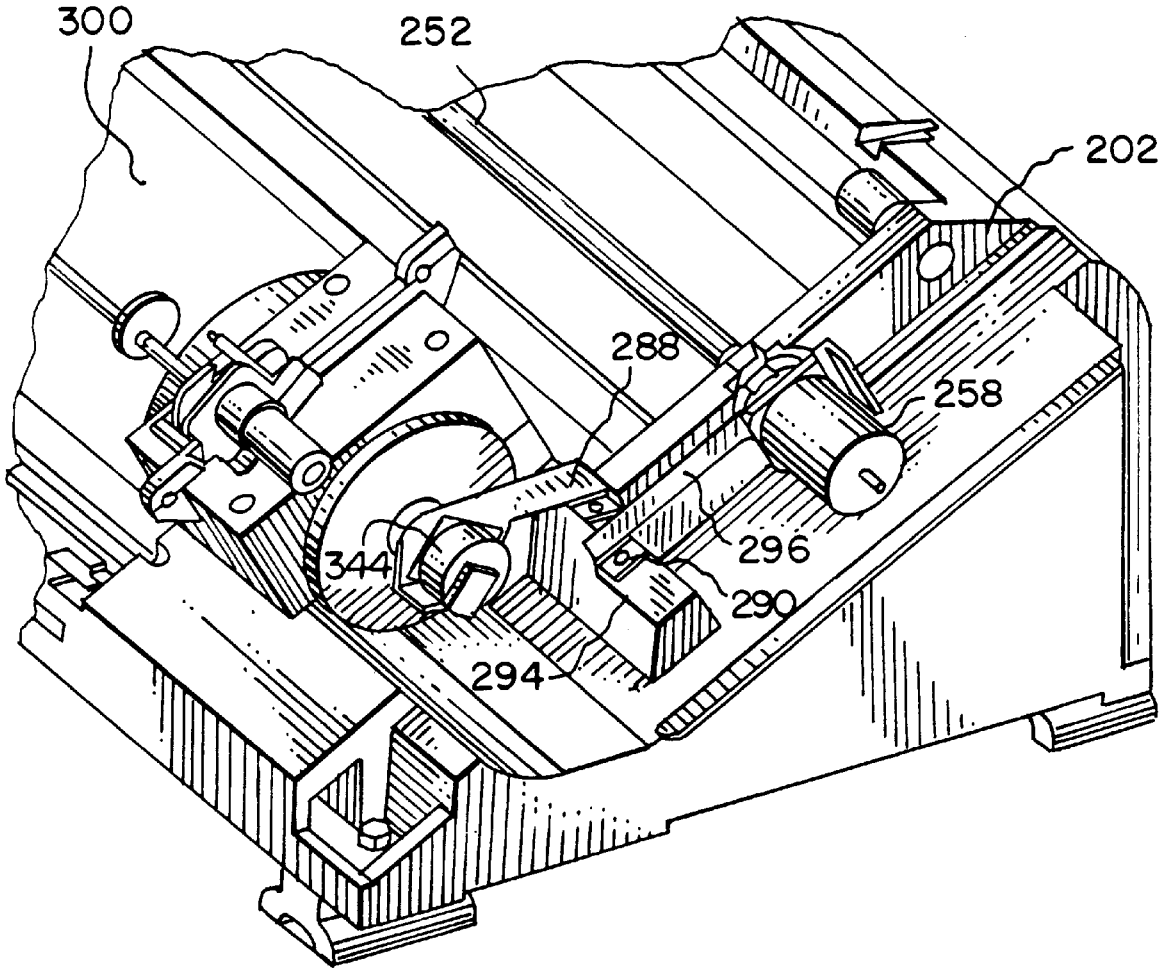
FIG. 3 is a perspective view showing the rotational stop as implemented for the present invention.

FIG. 3 shows the position of a rotational stop 296 for linear drive motor 258. A stop magnet 294 (position shown) is installed inside lathe bed scanning frame 202. Stop magnet 294 is, for example, NdFeB (Neodynium-ironboron) but can be any type of permanent magnet with a selectable level of magnetism for the application. Rotational stop 296 is held in place at a stop button 290 that is installed at the end of rotational stop 296. Linear drive motor 258 is coupled to threaded shaft 252 of lead screw 250. This arrangement allows the end of rotational stop 296 to be lifted from the frame so that linear drive motor 258 turns from its operating position. FIG. 3 also shows the position of a drum encoder 344 and a rotational stop-encoder 288.

Figure 4:
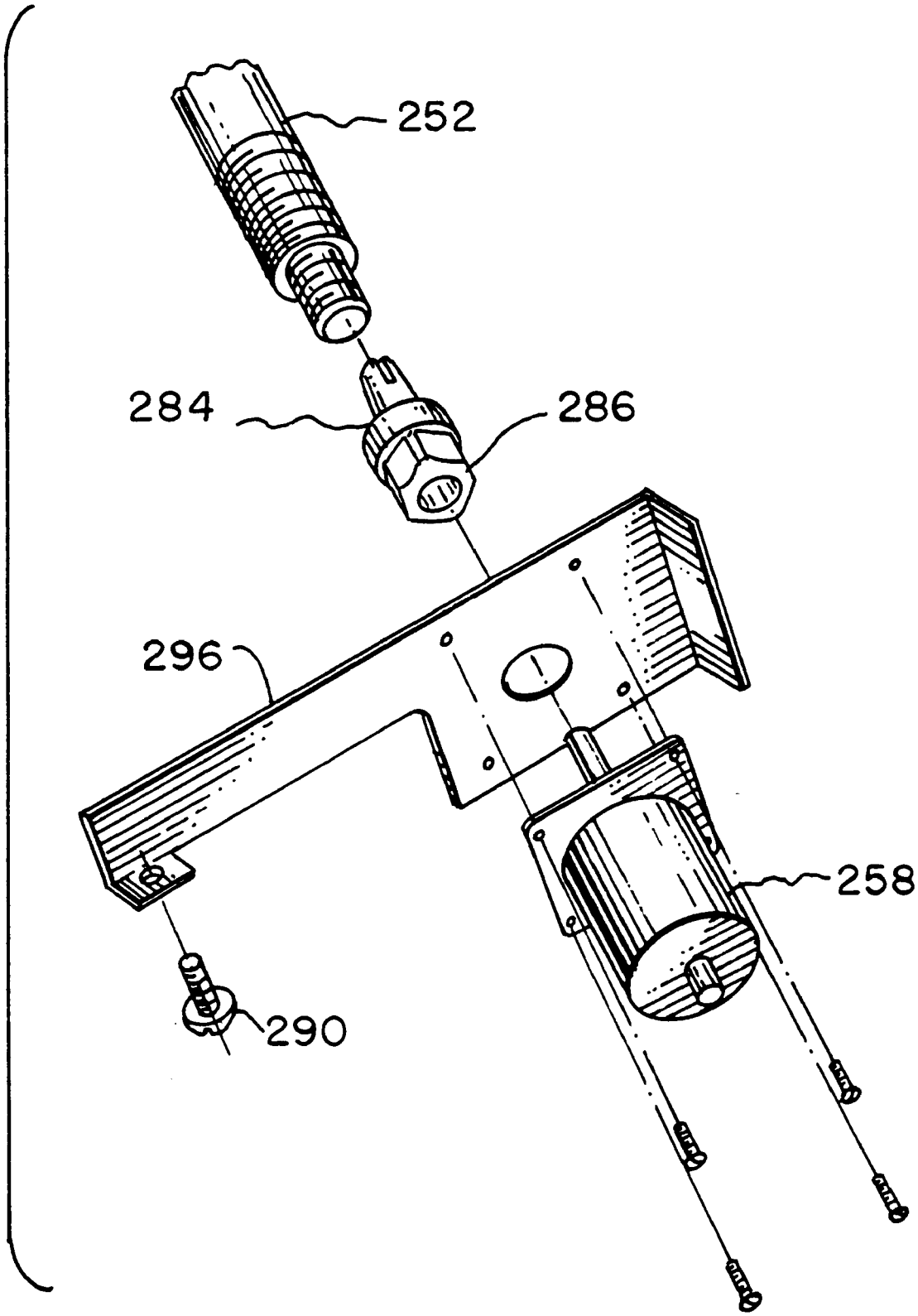
FIG. 4 shows an exploded view of the rotational stop components for the present invention.

FIG. 4 is an exploded view that shows the components that mount linear drive motor 258 to rotational stop-motor 296. A collet 284, secured by a nut collet 286, mounts to the threaded end of threaded shaft 252. Collet 284 grips the shaft of linear drive motor 258.

Stop button 290 fastens to the end of rotational stop-motor 296. The stop button is rounded so that it provides a single point of contact against a flat surface, where rotational stop 296 is held by stop magnet 294. This arrangement with single-point contact allows rotational stop 296 to have free-play while, at the same time, constraining movement of the motor or encoder body. This same stop button 290 configuration, with single-point contact, applies for rotational stop-encoder 288.

The invention has been described with reference to the preferred embodiment thereof. However, it will be appreciated and understood that variations and modifications can be effected within the spirit and scope of the invention as described herein above, and as defined in the appended claims, by a person of ordinary skill in the art without departing from the scope of the invention. For example, the invention is applicable to any rotational stop where a spring might otherwise be used as a holding mechanism. A rotational stop of this type can be used in a similar fashion as described above to support an encoder or other device mounted on a drive shaft. Either a permanent magnet or an electromagnet could be employed to provide constraining force for the rotational stop.

The invention has been described in detail with particular reference to preferred embodiments thereof, but it will be understood that variations and modifications can be effected within the spirit and scope of the invention.

What is claimed is:

1. An apparatus comprising:

a frame;

a threaded lead-screw rotatably mounted on the frame;

a threaded carriage mounted on the lead-screw for movement along the lead-screw as the lead-screw rotates;

a motor coupled to and supported by the lead-screw, the motor being adapted to drive the lead-screw; and a rotational stop attached to the motor, the rotational stop being magnetically held by the frame to prevent the motor from rotating with the lead-screw.

2. An apparatus as set forth in claim 1, further comprising a printhead carried by the carriage.

3. An apparatus as set forth in claim 1, wherein the rotational stop includes a permanent magnet to provide constraining force for the motor.

4. An apparatus as set forth in claim 1, wherein the rotational stop includes an electromagnet to provide constraining force for the rotational stop.

5. An apparatus as set forth in claim 1, wherein the rotational stop includes a rounded stop button adapted to provide a single point of contact against a flat surface of the frame.

6. An apparatus as set forth in claim 5, wherein the rotational stop includes a permanent magnet to provide constraining force for the motor.

7. An apparatus as set forth in claim 5, wherein the rotational stop includes an electromagnet to provide constraining force for the rotational stop.

8. An apparatus as set forth in claim 1, wherein the rotational stop includes a rounded stop button adapted to provide a single point of contact against a flat surface of the frame.

9. An apparatus as set forth in claim 8, wherein the rotational stop includes a permanent magnet to provide constraining force for the motor.

10. An apparatus as set forth in claim 8, wherein the rotational stop includes an electromagnet to provide constraining force for the rotational stop.

11. An apparatus comprising:

a frame;

a threaded lead-screw rotatably mounted on the frame;

a threaded carriage mounted on the lead-screw for movement along the lead-screw as the lead-screw rotates;

a motor coupled to and supported by the lead-screw, the motor being adapted to drive the lead-screw; and means for magnetically preventing the motor from rotating with the lead-screw.

12. An apparatus comprising:

a frame;

a threaded lead-screw rotatably mounted on the frame;

a threaded carriage mounted on the lead-screw for movement along the lead-screw as the lead-screw rotates;

a motor;

means for coupling the motor to the lead-screw such that the motor is supported by, and drives, the lead-screw; and means for magnetically preventing the motor from rotating with the lead-screw.

13. An apparatus comprising:

a frame;

a shaft rotatably mounted on the frame;

a motor coupled to and supported by the shaft, the motor being adapted to drive the shaft; and a rotational stop attached to the motor, the rotational stop being magnetically held by the frame to prevent the motor from rotating with the shaft.

14. An apparatus as set forth in claim 13, wherein the rotational stop includes a permanent magnet to provide constraining force for the motor.

15. An apparatus as set forth in claim 13, wherein the rotational stop includes an electromagnet to provide constraining force for the rotational stop.

16. An apparatus comprising:

a frame;

a shaft rotatably mounted on the frame;

a motor coupled to and supported by the shaft, the motor being adapted to drive the shaft; and means for magnetically preventing the motor from rotating with the shaft.

17. An apparatus comprising:

a frame;

a shaft rotatably mounted on the frame;

a motor;

means for coupling the motor to the shaft such that the motor is supported by, and drives, the shaft; and means for magnetically preventing the motor from rotating with the shaft.

* * * * *